US012392593B2

(12) United States Patent
Guyon et al.

(10) Patent No.: US 12,392,593 B2
(45) Date of Patent: Aug. 19, 2025

(54) METHOD FOR INSTALLING A SET OF ELECTRONIC DETONATORS AND ASSOCIATED IGNITION METHOD

(71) Applicant: DAVEY BICKFORD, Hery (FR)

(72) Inventors: Franck Guyon, Auxerre (FR); Raphaël Trousselle, Paris (FR); Stephanus Johannes Marais Combrinck, Clontarf (AU); Lou Dumanoir, Paris (FR)

(73) Assignee: DAVEY BICKFORD, Hery (FR)

( * ) Notice: Subject to any disclaimer, the term of this patent is extended or adjusted under 35 U.S.C. 154(b) by 239 days.

(21) Appl. No.: 18/252,325

(22) PCT Filed: Dec. 14, 2021

(86) PCT No.: PCT/FR2021/052319

§ 371 (c)(1),
(2) Date: May 9, 2023

(87) PCT Pub. No.: WO2022/129774

PCT Pub. Date: Jun. 23, 2022

(65) Prior Publication Data

US 2024/0003665 A1 Jan. 4, 2024

(30) Foreign Application Priority Data

Dec. 17, 2020 (FR) ..... 2013388

(51) Int. Cl.
*F42D 1/055* (2006.01)
*F42D 3/04* (2006.01)

(52) U.S. Cl.
CPC ..... *F42D 1/055* (2013.01); *F42D 3/04* (2013.01)

(58) Field of Classification Search
CPC ... F42D 1/055; F42D 1/05; F42D 3/00; F42D 3/04; F41A 17/08; F41A 19/65; F41G 3/04; F42C 15/40; F42C 15/42; F42C 15/44

(Continued)

(56) References Cited

U.S. PATENT DOCUMENTS 4,576,093 A * 3/1986 Snyder ..... F42D 1/05 102/200
5,792,978 A * 8/1998 Woodall, Jr. ..... F42D 3/00 102/293

(Continued)

FOREIGN PATENT DOCUMENTS

FR 3053111 A1 12/2017

OTHER PUBLICATIONS

International Search Report for PCT/FR2021/052319 mailed Mar. 28, 2022, 6 pages.

(Continued)

*Primary Examiner* — Michael D David
(74) *Attorney, Agent, or Firm* — NIXON & VANDERHYE

(57) ABSTRACT

A method for installing a set of electronic detonators in blast holes of a mining face includes the following steps: connecting detonators, charged into the blast holes, to a movable test device; receiving, by the movable test device, a message sent by each detonator; determining, from that message, a set of values, representing the total number of detonators connected to the movable test device; sending, to one or more detonators of the set, a data set to store including the set of values representing the total number of detonators connected to the movable test device; and storing the data set in the memory of one or more detonators of the set of electronic detonators. Use for later verification of the connection of the detonators before firing.

20 Claims, 4 Drawing Sheets

(58) Field of Classification Search
USPC ..... 102/200, 301, 311, 221, 313, 322, 401, 102/403, 426; 89/1.11
See application file for complete search history.

(56) References Cited

U.S. PATENT DOCUMENTS

| | | | | |
|---|---|---|---|---|
| 8,327,764 | B2 * | 12/2012 | Trousselle | F42B 3/182 102/202.3 |
| 2005/0103219 | A1 * | 5/2005 | McClure | F42D 1/055 102/311 |
| 2005/0217525 | A1 * | 10/2005 | McClure | F42D 1/055 102/311 |
| 2012/0299708 | A1 * | 11/2012 | Guyon | F42D 1/055 340/10.51 |
| 2015/0007740 | A1 * | 1/2015 | Guyon | F42D 1/055 102/215 |
| 2017/0003108 | A1 * | 1/2017 | Guyon | F42D 1/05 |
| 2018/0321024 | A1 * | 11/2018 | Guyon | F42B 3/121 |
| 2018/0347959 | A1 * | 12/2018 | Guyon | F42D 1/05 |
| 2021/0102792 | A1 * | 4/2021 | Guyon | F42D 1/04 |
| 2023/0036978 | A1 * | 2/2023 | Biard | F42D 1/05 |

OTHER PUBLICATIONS

Written Opinion of the ISA for PCT/FR2021/052319 mailed Mar. 28, 2022, 6 pages.

* cited by examiner

| Cat. | T (ms) |
|---|---|
| C1 | 0 |
| C2 | 250 |
| C3 | 500 |
| C4 | 750 |
| C5 | 1000 |
| C6 | 1250 |

METHOD FOR INSTALLING A SET OF ELECTRONIC DETONATORS AND ASSOCIATED IGNITION METHOD

CROSS-REFERENCE TO RELATED APPLICATIONS

This application is the U.S. national phase of International Application No. PCT/FR2021/052319 filed Dec. 14, 2021, which designated the U.S. and claims priority to FR 2013388 filed Dec. 17, 2020, the entire contents of each of which are hereby incorporated by reference.

BACKGROUND OF THE INVENTION

Field of the Invention

The present invention relates to an installation method for installing a set of electronic detonators at a mining face.

It also relates to a method for firing a set of electronic detonators installed at a mining face according to the installation method in accordance with the invention.

The present invention furthermore relates to a movable test device for the implementation of the installation method in accordance with the invention as well as to a system for firing a set of electronic detonators installed at a mining face according to the installation method in accordance with the invention.

Description of the Related Art

The present invention applies in general to the field of mines and quarries and to the sites of public works employing programmable electronic detonators and remote firing according to a predetermined firing layout.

The firing layout defines, at the mining face, the location of blast holes each configured to receive an electronic detonator associated with an explosive, as well as the firing sequence, that is to say the delay associated with each electronic detonator, according to its location in each blast hole of the mining face.

The firing of the electronic detonators according to a firing layout is conventionally implemented based on two main phases, one at the mining face, the other at a distance from the mining face.

Firstly, the electronic detonators are charged into the blast holes defined by the firing layout, then are identified one by one by means of a movable test device, at the mining face.

The movable test device is generally designed to read, send, test, program one or more electronic detonators simultaneously or individually, with contact or contactless.

The identifying step consists of reading a unique identifier associated with each electronic detonator by the movable test device progressively with the wired or wireless connection of each electronic detonator of the movable test device. A delay is then associated with each electronic detonator according to the chosen firing layout, which associates a predefined delay with each blast hole according to its location in the mining face This delay associated with each electronic detonator is stored in memory in the movable test device.

In some applications, it is provided at this stage to program and store in memory, in each electronic detonator, the firing delay which is associated with it according to the chosen firing layout.

Usually, the movable test device carries out a test of the electronic detonators connected to the bus line in order to verify the proper connection of the set of electronic detonators identified individually.

Once the preceding step has been carried out, the bus line on which are connected the electronic detonators is connected to a firing line and the latter is itself connected to a remote firing device.

The step of remote firing may then be implemented.

This step of firing may be launched several days, or possibly weeks, after the step of installing electronic detonators at a mining face.

Before the actual remote firing, the remote firing device carries out carries out a test step in order to verify that all the electronic detonators of the firing layout are properly connected to the firing line and that the conditions of firing the electronic detonators at the mining face are still satisfactory for setting off the firing.

For this, the remote firing device compares the individual identification information sent to it by each electronic detonator with the data saved by the movable test device at the test and installation step of the electronic detonators at the mining face.

Thus, the data saved by the movable test device at the installation step, that is to say the number of electronic detonators placed at the mining face and connected to the bus line, the unique identification associated with each electronic detonator as well as the delay associated with each electronic detonator (possibly programmed in each electronic detonator), are transferred from the movable test device to the remote firing device and are stored in memory to enable the implementation of the test before firing.

This data transfer may be carried out using a memory medium such as a USB key or possibly by a transmission using a wireless communication protocol between the movable test device and the remote firing device.

In practice, it is then necessary to move the movable test device and/or the memory medium over a large distance, between the mining face and the remote firing device.

SUMMARY OF THE INVENTION

The present invention is directed to solving at least one of the aforementioned drawbacks and to provide a simplified installation for a set of electronic detonators, then their firing according to a predefined firing layout.

To that end, according to a first aspect, the present invention relates to an installation method for installing a set of electronic detonators in blast holes of a mining face.

The installation method comprises the following steps:

- connecting electronic detonators charged into the blast holes to a movable test device;
- receiving, by the movable test device, a message sent by each detonator of said set of electronic detonators;
- determining, by the movable test device from said message sent by each detonator, a set of values representing the total number of electronic detonators connected to the movable test device;
- sending, by said movable test device to one or more detonators of said set of electronic detonators, a data set to store in memory comprising said set of values representing the total number of electronic detonators connected to the movable test device; and
- storing said data set in memory saving means of one or more detonators of said set of electronic detonators.

Thus, at least one detonator of the set of electronic detonators stores in memory at least some of a set of values representing the total number of electronic detonators connected to the movable test device at the time of the installation of the detonators at the mining face.

These items of information may thus be sent by at least one detonator once the electronic detonators have been connected to a remote firing device to enable the validation of the whole of the installation and of the proper connection, and in particular verify that there are no leakages of current on the line for connecting the electronic detonators to the remote firing device.

The storage in memory of information useful for the validation test in at least one electronic detonator makes it possible to dispense with the transfer of data between the movable test device and a remote firing device.

Therefore, it is not necessary to physically transfer the data, obtained at the time of the installation of the electronic detonators at the mining face, to the remote firing device.

According to one embodiment, at the sending step, said data set to store in memory is sent to all the detonators of the set of electronic detonators, said data set being stored in saving means of each detonator of the set of electronic detonators.

The redundant storage in memory of the data set in all the electronic detonators makes it possible to ensure the transfer of that data set later to a remote firing device, even in case of a fault in one or other of the detonators or its connection to the remote firing device.

Advantageously, said data set to store in memory further comprises a reference of the mining face.

Thus, when several firings are envisioned over a same period of time, the mining face reference makes it possible to verify the correct attribution of a stored data set to a particular mining face.

In a practical embodiment, said set of values comprises the total number of electronic detonators connected to the movable test device.

The total number of electronic detonators connected at the time of the installation method at the mining face makes it possible later to verify that the correct number of electronic detonators is connected to the remote firing device, prior to triggering the firing In a particular embodiment, each detonator comprises memory means for storing at least one reference of delay category chosen from among a predefined set of delay categories.

In one embodiment, the installation method further comprises, for each delay category, a step of issuing a test command by said movable test device to a sub-set of electronic detonators comprising a same reference of delay category stored in memory and, at the determining step, said set of values comprises, for each delay category, the number of electronic detonators comprising that same reference of delay category stored in memory.

This information on the number of electronic detonators of each delay category later makes it possible to verify that the correct number of electronic detonators, of each delay category according to the chosen firing layout, is connected to the remote firing device, before triggering firing.

In another embodiment, in addition to or alternatively to the preceding embodiment, at the step of receiving, by said movable test device, a message sent by each detonator of said set of electronic detonators, said message comprises at least the reference of delay category stored in said memory storage means of said detonator, and at the determining step, said set of values comprises, for each delay category, the number of electronic detonators comprising that same reference of delay category stored in memory.

Preferably, in order to verify that the detonators of all the delay categories implemented at the time of the installation at the mining face are properly connected, the data set to store in memory comprises the number of delay categories of said predefined set of delay categories.

In practice, at the memory storage step, the number of electronic detonators comprising said saved reference of delay category is stored respectively in the saving means of at least one electronic detonator comprising said stored reference of delay category.

In one embodiment, the installation method further comprises the following steps:

- selecting, in the movable test device, a template of associations of each delay category with a predefined delay according to a predetermined firing layout; and
- programming a firing delay in each detonator of the set of electronic detonators based on said template of associations and the reference of delay category stored in the memory means of said detonator.

This programming of the delay at the movable test device is simplified thanks to the use of a template of associations. The firing delay may be programmed automatically according to the delay category stored in memory at each detonator. All the detonators may be programmed simultaneously and not one by one.

According to a second aspect, the present invention also relates to a method for firing a set of electronic detonators installed at the mining face according to the installation method described above, implemented in a firing device.

The firing method comprises the following steps:

- connecting said set of electronic detonators to the firing device;
- receiving a message sent by each detonator of said set of electronic detonators;
- receiving said data set stored in said saving means of one or more detonators of said set of electronic detonators;
- extracting, from said stored data set, said set of values representing the total number of electronic detonators connected to the movable test device at the time of installing said set of electronic detonators at the mining face;
- determining the current number of electronic detonators of said set of electronic detonators connected to the firing device based on the message sent by each detonator of said set of electronic detonators;
- comparing said current number with said set of values representing the total number of electronic detonators connected to the movable test device; and
- issuing a validation message for a test if said current number is consistent with said set of values representing the total number and a non-validation message if said current number is not consistent with said set of values representing the total number.

Verifying proper connection of the set of detonators may thus be carried out based on the data set sent by one or more electronic detonators to the remote firing device and does not require the transfer of data between the movable test device used at the time of installing the detonators at the mining face and the firing device, remote from the mining face.

According to one embodiment, the method for firing a set of electronic detonators that is installed at the mining face comprises the following steps:

- connecting said set of electronic detonators to the firing device;
- receiving a message sent by each detonator of said set of electronic detonators, said message comprising at least the reference of delay category stored in said memory storage means of said detonator;

receiving said data set stored in said saving means of one or more detonators of said set of electronic detonators;

extracting, from said stored data set, said set of values comprising, for each delay category, the number of electronic detonators comprising said stored reference of delay category;

determining, for each delay category, the current number of electronic detonators comprising said stored reference of delay category, from said message sent by each detonator of said set of electronic detonators;

comparing, for each delay category, said current number with said number of electronic detonators comprising said stored reference of delay category; and issuing a test validation message if said current number is equal to said number of electronic detonators comprising said stored reference of delay category for all the delay categories, and a message of non-validation if said current number is different from said number of electronic detonators comprising said stored reference of delay category for at least one delay category.

The firing methods thus makes it possible to validate or not validate the installation of the electronic detonators and their connection before firing, based on the knowledge of the number of electronic detonators of each delay category.

According to another embodiment, the method for firing a set of electronic detonators that is installed at the mining face comprises the following steps:

connecting said set of electronic detonators to the firing device;

sending, for each delay category, a test command by said firing device to a sub-set of electronic detonators comprising a same stored reference of delay category;

receiving, for each delay category, a message sent by each detonator of said sub-set of electronic detonators comprising said same stored delay category;

receiving said data set stored in said saving means of one or more detonators of said set of electronic detonators;

extracting, from said stored data set, said set of values comprising, for each delay category, the number of electronic detonators comprising said stored reference of delay category;

determining, for each delay category, the current number of electronic detonators comprising said stored reference of delay category, from said message sent by each detonator of said subset of electronic detonators comprising said same stored delay category;

comparing, for each delay category, said current number with said number of electronic detonators comprising said stored reference of delay category; and issuing a test validation message if said current number is equal to said number of electronic detonators comprising said stored reference of delay category for all the delay categories, and a message of non-validation if said current number is different from said number of electronic detonators comprising said stored reference of delay category for at least one delay category.

In practice, at said step of issuing a non-validation message, the delay category or categories of which the current number is different from said number of electronic detonators comprising said stored reference of delay category is or are identified.

The operator can thus identify the defective detonators among the set of electronic detonators, and decide, according to the delay category concerned, to suspend the firing or trigger it.

In an advantageous embodiment, the firing method further comprises the following steps:

selecting a template of associations of each delay category with a predefined delay according to a predetermined firing layout; and programming a firing delay in each detonator of said set of electronic detonators based on said template of associations and the reference of delay category stored in the memory storage means of said detonator.

Programming the delay can thus be carried out from the remote firing device, and is simplified through the use of a template of associations. The firing delay may be programmed automatically according to the delay category stored at each detonator. All the detonators may be programmed simultaneously and not one by one.

According to a third aspect, the present invention also relates to a movable test device for the implementation of the installation method described above.

The movable test device comprises:

receiving means for receiving a message sent by each detonator of said set of electronic detonators charged into blast holes;

determining means for determining, from said message sent by each detonator, a set of values representing the total number of electronic detonators connected to said movable test device; and sending means for sending, to one or more detonators of said set of electronic detonators, a data set to store comprising said set of values representing the total number of electronic detonators connected to said movable test device.

The movable test device has features and advantages similar to the installation method it implements.

Lastly, according to a fourth aspect, the present invention relates to a firing system for a set of electronic detonators installed at the mining face according to the installation method described above.

The firing system comprises a movable test device configured to be connected to a bus line, the electronic detonators being connected to said bus line, and a firing device configured to be remotely connected via a firing line to said bus line.

In practice, each detonator of said set of electronic detonators comprises means for storing a reference of delay category chosen from among a predefined set of delay categories, each delay category being identified by a predefined combination of a numerical code and a color code, said numerical code being stored as reference of delay category in said storage means of each detonator.

Advantageously. said numerical code and said color code of each predefined combination are visible on at least one location chosen from among a connection cable of the electronic detonator or a connector of said electronic detonator to the bus line.

The combination of a number and of a color makes it possible to simply and visually define the delay category to which the electronic detonator belongs and thereby to facilitate its installation at the mining face.

In practice, said predefined set of delay categories comprises between 16 and 32, or even 64 different delay categories.

The firing system has features and advantages similar to the firing method described above.

BRIEF DESCRIPTION OF THE DRAWINGS

Still other particularities and advantages of the invention will appear in the following description with reference to the accompanying drawings which are given by way of non-limiting examples.

DETAILED DESCRIPTION

Figure 1:
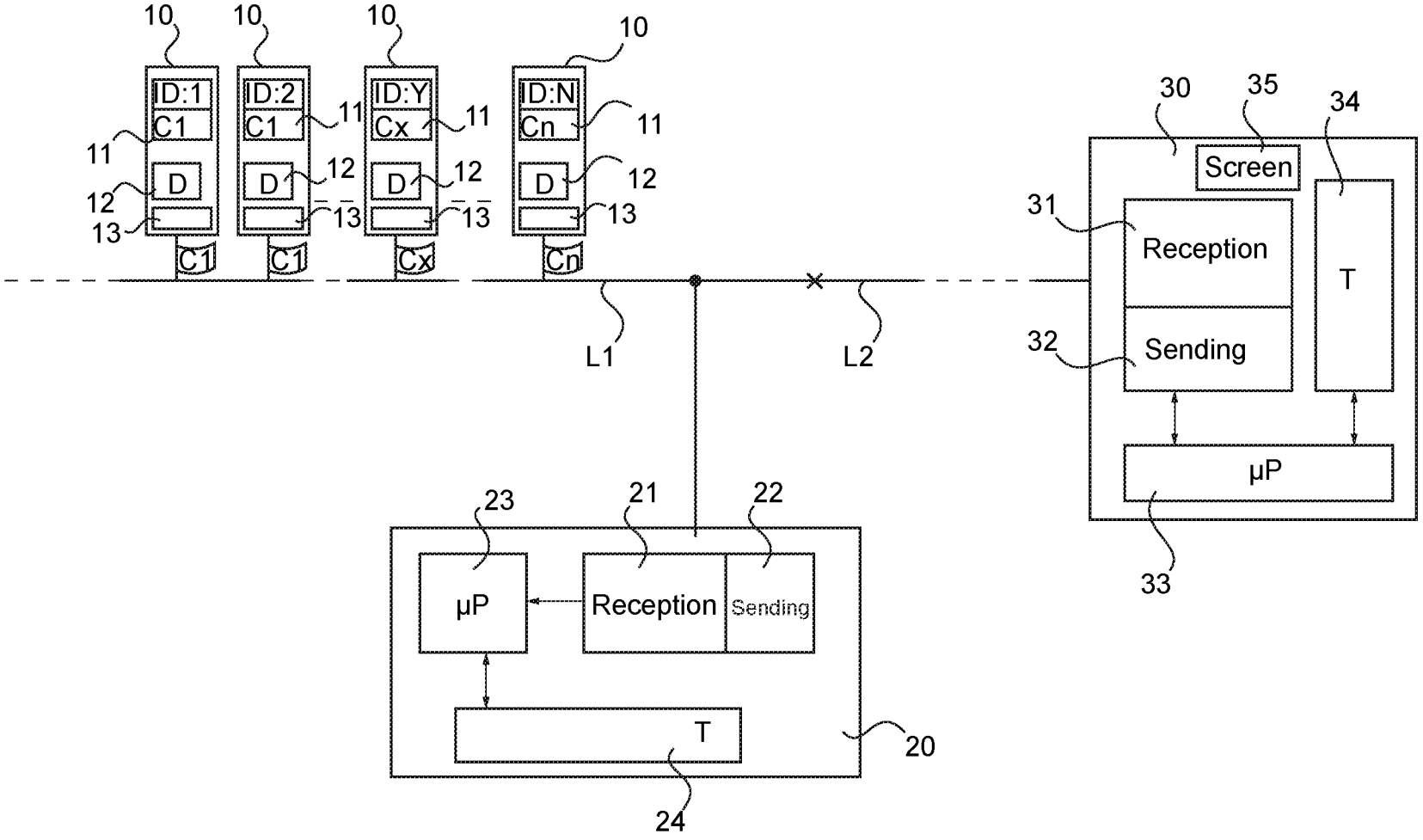
FIG. 1 is a diagrammatic view of a firing system in accordance with one embodiment of the invention.

A description will first of all be given with reference to FIG. 1 of a system for firing a set of electronic detonators installed at the mining face.

The firing system comprises several electronic detonators 10 each provided to be installed in a blast hole at the mining face.

In usual manner, each electronic detonator 10 is placed with a predetermined amount of explosive in a blast hole bored in a mining face.

The set of electronic detonators 10 so installed at the mining face are next configured to be fired in a single volley.

Such a firing system is used for example in particular in applications for mines, quarries and public works.

In this embodiment, the firing system comprises a mobile test device 20 configured to be connected to a bus line L1.

The electronic detonators 10 are also connected to the bus line L1 and thus connected to the mobile test device 20.

The mobile test device 20 may thus communicate with one or more electronic detonators 10, simultaneously or individually, in order to read information or data stored in memory by the electronic detonators 10, issue information to those electronic detonators 10 and test their connection and their operating state.

In some embodiments, the mobile test device 20 is also designed to program the electronic detonators 10, and for example program a firing delay as will be described in more detail below.

The mobile test device 20 comprises, in conventional manner, receiving means 21 and sending means 22 making it possible to communicate with the electronic detonators 10, simultaneously or individually.

The receiving means 21 are configured in particular to receive a message issued by each electronic detonator 10, simultaneously or individually. The sending means 22 are configured to issue messages and/or information to store or program in each electronic detonator 10.

The receiving means 21 and sending means 22 may be formed by a bi-directional emitter/receiver, known to the person skilled in the art in the field of wired communication networks.

Although, in the example embodiment illustrated in FIG. 1, the electronic detonators 10 and the mobile test device 20 are connected by a wired connection by means of the bus line L1, the invention is not limited to that type of connection.

In particular, the mobile test device 20 and the electronic detonators 10 could communicate via a wireless connection, for example by radio link. The receiving means 21 and sending means 22 may then be formed by a bi-directional emitter/receiver antenna, known to the person skilled in the art in the field of wireless communication networks.

The movable test device 20 further comprises a microprocessor 23 making it possible to implement different data processing operations, computations and parameterizations as will be described later with reference to the installation method for installing electronic detonators at the mining face.

The movable test device 20 also comprises a memory of EEPROM type (EEPROM being an acronym for Electrically Erasable Programmable Read Only Memory).

The role and the operation of the movable test device 20 will be described in more detail with reference to the installation method for installing electronic detonators 10 at the mining face.

The firing system further comprises a firing device 30 provided to be remotely connected to electronic detonators 10.

As illustrated in FIG. 1, the firing device 30 is connected via a firing line L2, itself connected to the bus line L1.

The firing device 30 is provided to be placed at a long distance from the mining face to enable triggering of the firing in full safety for the operator actuating firing from the firing device 30.

The firing device 30 comprises receiving means 31 and sending means 32 enabling bi-directional communication between the electronic detonators 10 and the firing device 30, simultaneously or individually.

The receiving means 31 and sending means 32 are similar to those described earlier in connection with the mobile test device 20.

The firing device 30 further comprises a microprocessor 33 making it possible to implement different data processing operations, computations and parameterizations as will be described later with reference to the firing method as described later.

A programmable memory 34 of EEPROM memory type is also provided in the firing device 30.

A display screen 35 may also equip the firing device 30 to communicate with the operator.

The role and the operation of the firing device 30 will be described in more detail with reference to the firing method.

Each electronic detonator 10 comprises bidirectional communication means 13 configured for the communication of the electronic detonator 10 with the movable test device 20 and/or the firing device 30 The bidirectional communication means 13 of the electronic detonators are similar to the receiving means 21 and sending means 22 described earlier with reference to the movable test device 20.

Furthermore, each electronic detonator 10 comprises memory storage means 11 configured to store identification information specific to each electronic detonator 10.

These memory means 11 are formed for example by a ROM or Read Only Memory or by a writable memory of EEPROM type.

In particular, each electronic detonator 10 is associated with a unique identifier ID parameterized in the electronic detonator 10 at the time of its manufacture.

The value IDY of this identifier ID is comprised here, purely by way of example, between ID1 and IDN, N corresponding to the total number of electronic detonators 10 installed at the mining face for performing firing.

In the illustrated embodiment, and without being limiting, each electronic detonator 10 also comprises a reference x of delay category Cx saved in the memory means 11.

In its principle, the implementation of a delay category Cx consists of pre-categorizing the electronic detonators 10 according to their delay category Cx, all the electronic detonators 10 associated with the same delay category Cx then being programmed with a same firing delay according to a predetermined firing layout.

Each delay category Cx is preferably identified by a predefined combination of a numerical code x and of a color code.

The numerical code or number x is stored in memory as a reference of delay category Cx in the memory means 11 of each electronic detonator 10.

In order to facilitate the installation of the electronic detonators 10 in the blast holes at the mining face, the delay category Cx with which is associated the electronic detonator is visible on each electronic detonator 10.

The use of a numerical code or number x and of a color code makes it possible to facilitate, in combination, the identification by the operator at the mining face, of each electronic detonator 10 to install.

Preferably, the number x and the color that is associated with each combination are visible on the electronic detonator 10.

The number x and/or the color code may be visible for example on the cable for connecting the electronic detonator 10 to the bus line L1.

This embodiment has been illustrated in FIG. 1 in which a different color label, bearing the number 1, x, . . . , n, is attached to the connection cable for each electronic detonator 10.

Of course, other types of location could be chosen to make visible the delay category Cx with which is associated the electronic detonator 10.

For example, the combination of the numerical code and of the color code identifying each delay category Cx could also be visible on a connector (not shown) connecting the electronic detonator 10 to the bus line L1.

Moreover, a label of RFID type may be fastened to an outside face of the casing of the electronic detonator 10. This label may thus comprise not only the color code and the numerical code x of the delay category Cx but also the identifier IDY of the electronic detonator 10.

The advantage of the categorization of the electronic detonators 10 will appear in more detail below, with reference to the method for installation and firing the electronic detonators.

Lastly, each electronic detonator 10 further comprises saving means 12 formed by an EEPROM type writable memory.

In practice, the saving means 12 may be distinct from the memory means 11 of each electronic detonator 10 or be formed from a same EEPROM memory with separate registers for the storage of the different data.

As will appear in the description below, the saving means 12 make it possible to store locally, at each of or some of the electronic detonators 10, data in connection with the firing layout in which are implemented those electronic detonators 10.

Figures 2, 3:
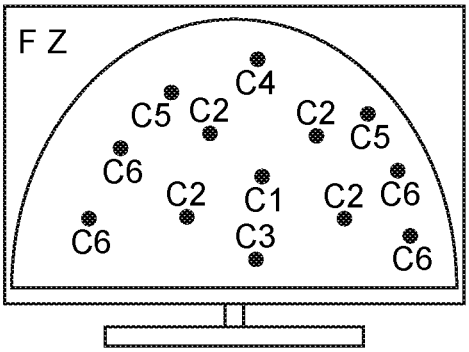
FIG. 2 is a diagram illustrating the programming of a firing layout for a firing system of FIG. 1.
FIG. 3 is a diagram illustrating a template of associations of delay categories with predefined delays according to the example of the firing layout of FIG. 2.

An illustration is provided in FIG. 2 of a firing layout associated with a mining face identified by a reference FZ When a firing layout is defined, the programmer defines, at the mining face, the location of the various electronic detonators 10, which are diagrammatically illustrated by dots in FIG. 2 and associates with them a firing delay.

An associations template T such as illustrated in FIG. 3, is then defined in parallel, enabling a firing delay (in millisecond) to be associated with each delay category Cx.

By way of non-limiting example, FIGS. 2 and 3 illustrate the implementation of six delay categories C1, C2, C3, C4, C5, C6 respectively associated with 0, 250, 500, 750, 1000, 1250 ms of firing delay.

Of course, this example embodiment is purely illustrative.

In practice, the predefined set of delay categories Cx comprises between 16 and 32 different delay categories for the creation of a conventional firing layout. This number may be raised to 64 for larger firing layouts. Typically, the use of 20 to 25 different delay categories makes it possible to produce a firing layout for a given mining face FZ.

The use of an associations template T avoids having to know the value of the firing delay in the firing layout as illustrated not FIG. 2.

Indeed, the firing layout may be carried out by locating the electronic detonators 10 having the same firing delay by attributing to them a delay category Cx, this being for each different firing delay of the firing layout. The associations model T next makes it possible to define the firing delay for each delay category Cx.

In the firing layout as illustrated in FIG. 2, each electronic detonator 10 may thus be viewed by a dot of color and a number x, corresponding to the color code and the numerical code characterizing its delay category Cx.

Figure 4:
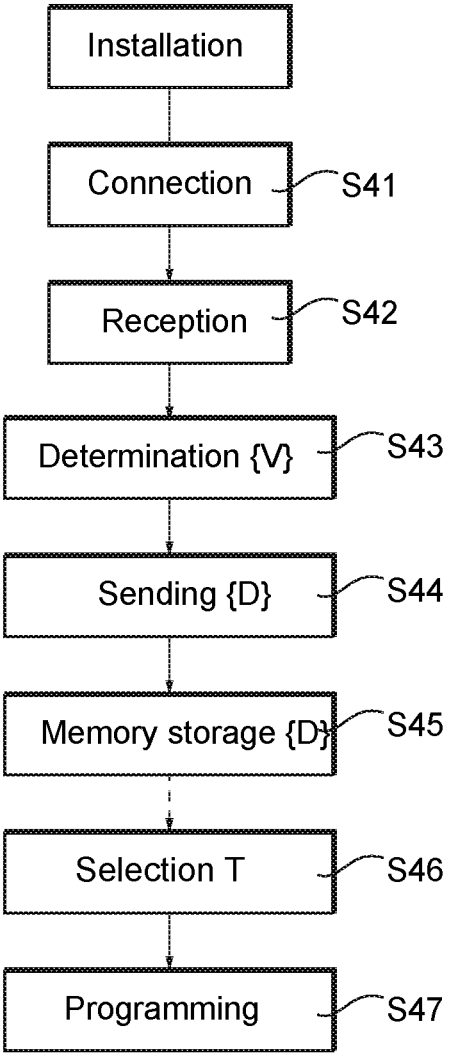
FIG. 4 is an algorithm of an installation method for installing a set of electronic detonators according to one embodiment of the invention.

A description will now be given with reference to FIG. 4 of an installation method for installing a set of electronic detonators 10 according to one embodiment of the invention.

As described above with reference to FIG. 1, each electronic detonator 10 is placed in a blast hole of a mining face.

This placement of the electronic detonators is made according to the firing layout such as that given as an example in FIG. 2.

To that end, the installer may have a charge map, available for example on the movable test device 20, making it possible to identify the location of each electronic detonator and its delay category Cx, seen by the associated color code and numerical code x.

This charge map simplifies the placement of each electronic detonator 10 in the dedicated blast hole.

The installer may, for a given mining face FZ, take the required number of electronic detonators 10 of each delay category Cx, then dispose them at the mining face FZ by just complying with the color code and/or the numerical code of the charge map.

The installation method next comprises a step S41 of connecting the electronic detonators 10 to the movable test device 20.

In the example embodiment described with reference to FIG. 1, and without being limiting, the electronic detonators 10 are connected via a bus line L1, itself connected to the movable test device 20.

The installation method next comprises a step S42 of receiving, by the movable test device 20, a message sent by each electronic detonator 10.

The issuing of a message by each electronic detonator 10 may be carried out spontaneously.

For example, the issuing of a message by each detonator may take place as of its connection to the bus line L1, itself connected to the movable test device 20.

Each electronic detonator 10 is thus configured to issue a message to the movable test device 20 as of its powering-up.

The messages at the receiving step S42 are thus received in succession, progressively with the connection of the electronic detonators to the bus line L1.

Alternatively, in another embodiment, the movable test device 20 sends, in an issuing step, a test command to all the electronic detonators 10, after their connection to the bus line L1.

The receiving step S42 then makes it possible to receive, simultaneously or individually, a message in response, sent by each electronic detonator 10 to the movable test device 20.

The receiving step S42 is implemented by the receiving means 21 of the movable test device 20.

The installation method next comprises a step S43 of determining, from the message sent by each electronic detonator 10, a set of values V representing the total number of electronic detonators 10 connected to the movable test device 20.

The determining step S43 is implemented by the determining means formed by the microprocessor 23, from messages received at the receiving step S42.

In particular, this set of values V determined by the movable test device 20 may comprise the total number N of electronic detonators 10 connected to the movable test device 20.

The total number N of electronic detonators 10 may be determined from the number of messages received at the receiving step S42.

More particularly, in the embodiment illustrated in FIG. 1, in which each electronic detonator 10 is associated with a delay category Cx, at the determining step S43, the set of values V comprises, for each delay category Cx, the number Nx of electronic detonators 10 comprising the reference x of delay category Cx stored in the memory means 11.

The set of numbers Nx of electronic detonators associated with each delay category Cx thus forms a set of values V representing the total number N of electronic detonators 10 at the mining face.

In such an embodiment, the determining step S43 may also make it possible to specifically determine the total number N of electronic detonators 10 by the following calculation:

$$N=\Sigma_1^n Nx(Cx)$$

where n is the number of delay categories used in the firing layout implemented.

In order to enable the determination of the number Nx of electronic detonators 10 associated with the delay category Cx, at the receiving step S42, the message comprises at least the reference x of delay category Cx stored in the memory means 11 of the electronic detonator 10, this being for each electronic detonator 10 connected to the movable test device 20.

In such an embodiment, the number n of delay categories Cx of the predefined set of delay categories that are used in the mining face FZ may then also be determined from the set of the messages received. For example, the microprocessor 23 is configured to compute the sum of the different references x of delay category Cx extract from the messages received.

The number n of delay categories Cx is useful for later verifying, at a test prior to triggering the firing as described below, that the electronic detonators 10 of each delay category Cx of the predefined set of delay category Cx implemented in the firing layout are indeed present.

Alternatively, it is possible for the message sent by each electronic detonator 10 not to comprise information on the delay category Cx with which each electronic detonator is associated.

In this case, the movable test device 20 queries the electronic detonators 10, delay category by delay category, only the electronic detonators 10 associated with the same delay category Cx simultaneously issuing a message to the movable test device 20. This latter may thus determine, at the determining step S43, the number Nx of electronic detonators 10 associated with the delay category Cx.

In such an embodiment, the delay categories Cx used for the mining face FZ must be stored in memory at the movable test device 20 to enable the electronic detonators 10, to be queried, delay category by delay category.

At the determining step S43, the set of values V thus comprises the total number N of electronic detonators at the mining face, directly determined from the number of messages received and/or determined indirectly from the number Nx of electronic detonators of each delay category Cx.

This information determined upon the implementation of the installation method for installing for the electronic detonators 10 at the mining face is useful for verifying the proper operation and correct connection of each electronic detonator 10 at the time of triggering firing, which may occur several days, or even several weeks, after the installation of the electronic detonators 10 at the mining face.

To that end, the installation method comprises a step S44 of sending, by the movable test device 20, of a data set D to store at one or more electronic detonators 10.

The receiving step S42 is implemented by the receiving means 22 of the movable test device 20. The data set D is received by the bi-directional communication means 13 of the electronic detonator or detonators 13.

The data set D is configured to be stored in the saving means 12 of an electronic detonator 10.

The electronic detonator 10 which stores the data set D may be selected in random manner by the movable test device 20 from among the set of electronic detonators 10, or instead be selected according to the power of the message sent by each electronic detonator 10. In this last case, the electronic detonator 10 having a response signal of greater amplitude may be selected.

The data set D to store comprises the set of values V representing the total number N of electronic detonators 10 connected to the movable test device 20.

The installation method thus comprises a step S45 of storing the data set D in a writable memory of at least one electronic detonator 10.

The information such as the total number N of electronic detonators 10 connected to the movable test device 20 may thus be stored in memory at one or more electronic detonators connected to the bus line L1.

In one embodiment, at the sending step S44, the data set D to store in memory is sent to all the electronic detonators 10 of the set of electronic detonators connected to the bus line L1.

Therefore, the data set D is stored in the saving means 12 of each electronic detonator 10 of the set of electronic detonators.

The information thus stored in memory is then available at any one of the electronic detonators 10.

Therefore, in case of defectiveness of one or other of the electronic detonators 10, the redundant storage in memory of the data set D makes it possible to make secure the availability of that information at all the electronic detonators 10.

Alternatively, at the step S44 of storing in memory, the number Nx of electronic detonators 10 associated with the delay category Cx is stored in memory in the saving means 12 of at least one electronic detonator 10 which comprises that reference of delay category Cx stored in the memory means 11.

Thus, the storage in memory of the number Nx of electronic detonators 10 associated with each delay category Cx is distributed among the electronic detonators 10 of each delay category Cx.

For reasons of redundancy, the number Nx of electronic detonators 10 associated with the delay category Cx may be stored in the saving means 12 of all the electronic detonators 10 that comprise that reference of delay category Cx stored in their memory means 11.

In addition to the total number N of electronic detonators and/or the number Nx of electronic detonators 10 of each delay category Cx, the data set D to store may also comprise a reference FZ of the mining face from among a set of mining faces.

In the context of planning multiple firings, the reference FZ of the mining face, as associated with the firing layout at the time of its programming as explained earlier with reference to FIG. 2, makes it possible to verify later, in particular before the programming of the delays for each electronic detonator, the match between the firing layout used with the mining face FZ to program.

The data set D to store in memory may also comprise the number n of delay categories Cx used in the mining face FZ.

The installation method for installing electronic detonators 10 and their reading and programming by the movable test device 20 may be finished at this stage.

However, it is also possible to provide for the programming by the movable test device 20 of the predefined delay associated with each electronic detonator 10 according to the firing layout.

In this case, the installation method further comprises a step S46 of selecting an associations model T such as illustrated in FIG. 3, associating each delay category Cx with a predefined delay according to a predetermined firing layout.

The selection of an associations model T is carried out by an operator, from associations models T stored in the memory 24 of the movable test device 20.

Based on this associations model T, a programming step S47 is implemented by the movable test device 20: the predefined delay is sent to each electronic detonator 10 according to the delay category Cx that is associated with it. The predefined delay is then stored in the saving means 12 of each electronic detonator 10.

The programming step S47 is thus implemented based on the associations model T and the reference of delay category Cx stored in the memory means 12 of each electronic detonator 10.

The use of an associations model T makes it possible to simultaneously program the predefined delay in the set of electronic detonators based on the reference of delay category Cx stored in memory.

The programming of the delay in each electronic detonator 10 according to a firing layout is thus facilitated.

Figure 5:
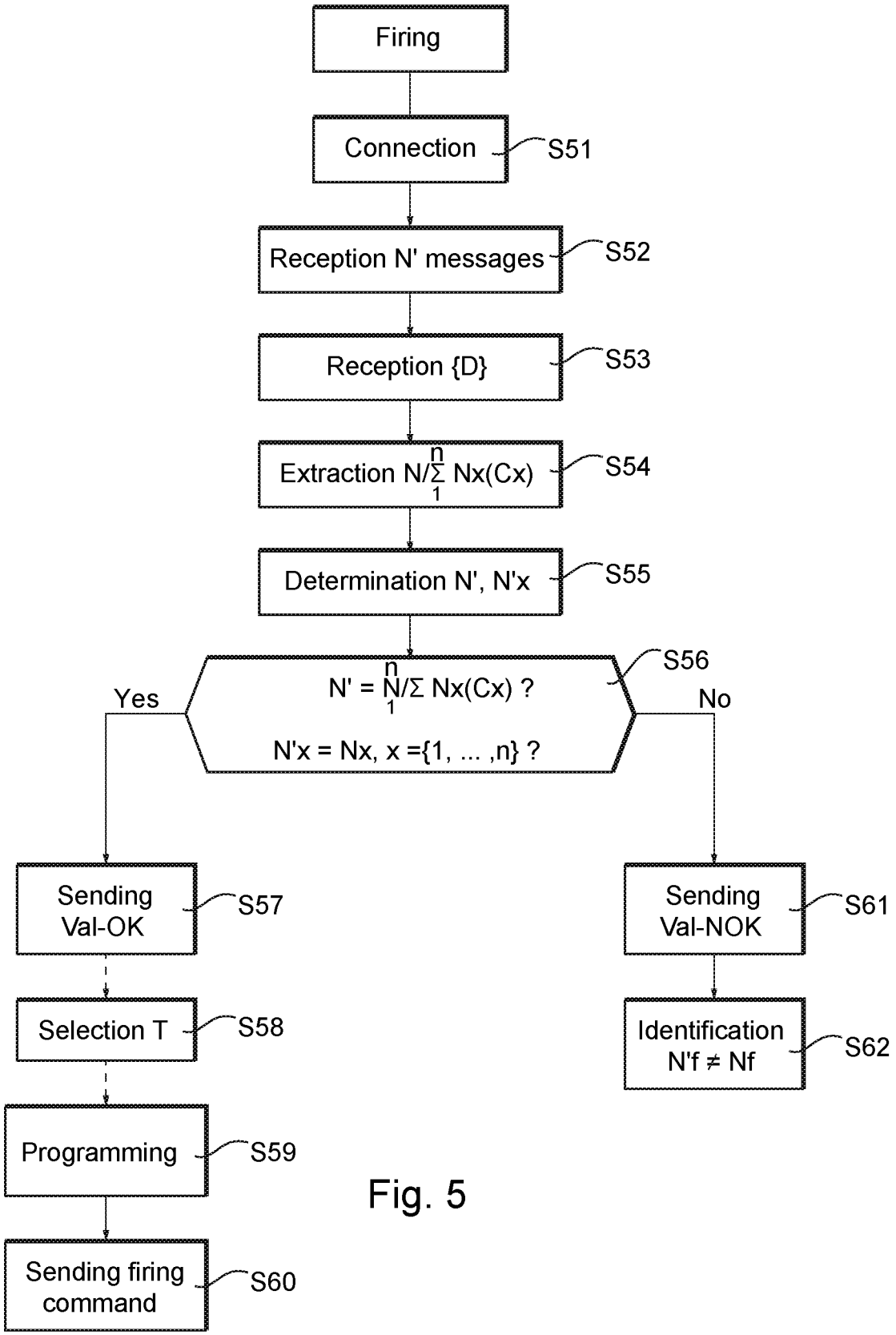
FIG. 5 is an algorithm of a method for firing a set of electronic detonators according to one embodiment of the invention.

A description will now be given with reference to FIG. 5 of method for firing a set of electronic detonators installed at the mining face.

The firing method is implemented in the firing device 33 as illustrated in FIG. 1, which may be placed far from the mining face FZ and from the electronic detonators 10.

Moreover, the method for firing the set of electronic detonators 10 may be implemented a long time after the step of installing the electronic detonators 10 in the blast holes.

It is thus of the utmost importance to test, before triggering firing, that the set of electronic detonators 10 are indeed in operational state and connected to the firing device 30 to receive the firing instruction.

To that end, the firing method first of all comprises a step S51 of connecting the set of electronic detonators 10 to the firing device 30.

In practice, the connection may be carried out by a firing line L2 connected to the bus line L1 to which have been connected the electronic detonators 10 at the time of the installation at the mining face.

The firing method next comprises a step S52 of receiving a message sent by each electronic detonator 10.

The firing device 30 thus receives, at the receiving means 31, a number N' of messages sent by the set of the electronic detonators 10 connected to the firing device 30.

The issuing of the messages by the electronic detonators 10 may be spontaneous, as of powering-up of the electronic detonators 10 at the time of the connection and/or the powering-up of the firing device 30.

In an alternative embodiment, the firing device 30 may be configured to implement a step of sending, by the sending means 32 of a test command to the set of electronic detonators 10.

The receiving step S52 is then configured to receive in response the messages sent by each electronic detonator 10.

The firing method also comprises a step S53 of receiving the data set D stored in the saving means 12 of at least one electronic detonator 10.

As indicated earlier, the data set D may be stored in memory in one, several or all of the electronic detonators 10 of the set of electronic detonators installed at the mining face.

More particularly, and without being limiting, in the implementation illustrated in FIG. 1 for which each electronic detonator 10 is associated with a delay category Cx, at the step S52 of receiving a message sent by each electronic detonator 10, the message further comprises at least the reference of delay category Cx stored in the memory means 11 of the electronic detonator 10.

Alternatively, the firing device 30 may be configured to implement a step of sending, for each delay category Cx, a test command sent to the sub-set of electronic detonators 10 comprising the same stored reference of delay category Cx.

The number of messages received thus directly corresponds to the current number of electronic detonators 10 that are associated with that delay category Cx.

The firing method next comprises a step S54 of extracting, from the data set D, a set of values V representing the total number N of electronic detonators 10 that are connected to the movable test device 20 at the time of the installation of the set of electronic detonators 10 at the mining face.

The extracting step S54 is implemented by the microprocessor 33 of the firing device 30.

The set of values representing the total number of electronic detonators may, as indicated earlier, correspond to the total number N of electronic detonators 10 that are connected to the bus line L1 and/or to the numbers Nx of electronic detonators 10 that are associated with each delay category Cx, this being for the predefined set {1, . . . , x, . . . , n} of delay categories Cx.

At the extracting step S54, it is also possible to extract, from the data set D, the reference FZ of the mining face concerned as well as the number n of delay categories Cx used in the mining face at the time of the installation of the electronic detonators 10.

The firing method further comprises a step S55 of determining, based on the step S52 of receiving messages sent by each electronic detonator 10, the current number N' of electronic detonators 10 connected to the firing device 30.

The determining step S55 is implemented by a calculating device of the microprocessor 33 of the firing device 30.

The current number N' may thus be calculated from the sum of the messages received at the receiving step S52.

In the embodiment in which the message received at the receiving step S52 comprises the reference of delay category Cx stored in memory in each electronic detonator 10, the determining step S55 is configured to determine, for each delay category Cx, the current number N'x of electronic detonators 10 associated with that delay category Cx.

In the embodiment in which the electronic detonators 10 are queried, delay category by delay category, by the firing device 30, the number of messages received in response to each sending of a test command corresponds to the current number N'x of electronic detonators 10 associated with that delay category Cx.

The current number N'x of electronic detonators 10 associated with each delay category Cx also makes it possible to determine alternatively, by sum calculation, the current number N' of electronic detonators connected to the firing device 30.

It will thus be noted that, based on the data set D sent by the electronic detonators 10, it is possible to know, at the firing device 30, the installation conditions of the electronic detonators 10 at the mining face, and in particular the total number N of electronic detonators connected to the bus line L1, as well as the number Nx of electronic detonators 10 associated with each delay category Cx.

This information can thus be sent directly, from one or more electronic detonators 10 to the firing device 30 and avoid any information transfer by the movable test device 20 or any other information medium.

Based on the extracting and determining steps S54 and S55, a comparing step S56 is implemented by the microprocessor 33 of the firing device 30.

At this comparing step S56, the current number N' of electronic detonators 10 connected to the firing device 30 is compared with the set of values representing the total number N of electronic detonators connected to the movable test device 20 at the time of the installation of the electronic detonators 10.

As indicated earlier, the current number N' is calculated from the number of messages received at the receiving step S52.

At the comparing step S56, the current number N' is compared with the total number N of electronic detonators 10 or with the sum of the number Nx of electronic detonators 10 associated with each delay category Cx.

In practice, the current number N' is consistent with the set of values V representing the total number N when $$N'=N$$

or $$N' = \sum_{1}^{n} Nx(Cx)$$

where n is the number of delay categories of the set predefined at the time of the installation of the electronic detonators at the mining face.

In the embodiment in which each electronic detonator 10 is associated with a delay category Cx, the comparing step S56 also comprises a comparison, for each delay category Cx, x belonging to {1, . . . , n}, of the current number N'x of electronic detonators 10 connected to the firing device 30 with the number Nx of electronic detonators 10 associated with the delay category Cx.

In practice, the current number N'x of electronic detonators 10 connected to the firing device 30 is consistent with the number Nx of electronic detonators 10 associated with the delay category Cx when $$N'x=Nx,$$

this being for any delay category Cx, x belonging to {1, . . . , n}.

Depending on the result of the comparison or comparisons, a step S57 of issuing a validation message VAL-OK is implemented if the current number N' is consistent with the set of values representing the total number N of electronic detonators connected to the movable test device 20 at the time of the installation, and if, for all the delay categories Cx, the current number N'x is consistent with the number Nx of electronic detonators 10 associated with the delay category Cx at the time of the installation of the electronic detonators 10, when the electronic detonators associated with a delay category Cx are implemented.

This step S57 of issuing a message may be carried out by issuing an audible message or information or warning displayed on a display screen 35 of the firing device 30.

As indicated earlier, the programming of the predefined delay associated with each electronic detonator 10 may be implemented by the firing device 30.

In this case, the installation method further comprises a step S58 of selecting an associations model T such as illustrated in FIG. 3, associating, for each delay category Cx, a predefined delay according to a predetermined firing layout. Selecting the associations model T may be implemented based on associations templates saved in the programmable memory 34 of the firing device 30.

When several firings are programmed and are to be implemented by the firing device 30, the reference FZ of the mining face makes it possible to select the associations model T corresponding to the selected firing layout.

By virtue of the associations model T, the predefined delay may be programmed simultaneously in all the electronic detonators 10, in a single programming step S59.

The programming step S59 is thus implemented based on the associations model T and the reference of delay category Cx stored in the memory means 11 of each electronic detonator 10.

In practice, a general message, comprising according to the associations model T, a predefined delay associated with each delay category Cx may be sent to all the electronic detonators 10, the programming of each predefined delay being implemented according to the reference of delay category Cx stored in the memory means 11 of each electronic detonator 10.

The programming of the delay in each electronic detonator 10 according to a firing layout is thus facilitated.

After this procedure of testing and validating the connection of the set of electronic detonators 10 by the firing device 30, and optionally the programming of the delay associated with each electronic detonator 10, a step S60 of sending a firing instruction may be implemented in full safety for triggering the firing.

On the contrary, if further to the comparing step S56, the current number N' of electronic detonators 10 is not consistent with the set of values V representing the total number N of electronic detonators connected to the movable test device 20 at the time of installation, a step S61 of issuing a message of non-validation VAL-NOK is implemented.

This VAL-NOK message is sent to the operator and avoids triggering the firing when the electronic detonators 10 are not all connected, are defective or else are in greater number than those charged into the blast holes at the time of installation. This VAL-NOK message may also be an audible warning or a message displayed on the screen 35 of the firing device 30.

In the embodiment in which each electronic detonator 10 is associated with a delay category Cx, the comparing step S56 also comprises the comparison, for each delay category Cx, of the current number N'x of electronic detonators 10 with the number Nx of electronic detonators 10 associated with the delay category Cx.

If the current number N'x is different from the number Nx for at least one delay category Cx, the step S61 of issuing a non-validation message VAL-NOK is implemented.

An identifying step S62 is implemented in order to identify the delay category or categories Cf for which the current number N'f is different from the number Nf of electronic detonators 10 comprising the reference of delay category Cf stored in memory.

The identifying step S62 thus makes it possible to indicate to the operator the delay category or categories Cf for which there are one or more additional electronic detonators for example, or one or more electronic detonators 10 that are defective, or not connected to the firing device 30.

According to the importance of those defective electronic detonators 10 in the course of the firing, the operator may decide to interrupt or trigger the firing.

The identifying step S62 thus enables an improved management of the remote firing, avoiding intervention at the mining face by virtue of the identification of the defective electronic detonators 10 in the firing layout.

Naturally, the present invention is not limited to the embodiments described and illustrated.

In particular, the method for installing and firing may be implemented using electronic detonators that are not categorized according to a delay to program later.

The invention claimed is:

1. A method for installing a set of electronic detonators in blast holes of a mining face, the method comprising:

connecting said electronic detonators charged into the blast holes to a movable test device;

receiving, by said movable test device, a message sent by each detonator of said set of electronic detonators;

determining, by said movable test device from said message sent by each detonator, a set of values representing the total number of electronic detonators connected to the movable test device;

sending, by said movable test device to one or more detonators of said set of electronic detonators, a data set to store in memory comprising said set of values representing the total number of electronic detonators connected to the movable test device; and storing said data set in memory saving means of one or more detonators of said set of electronic detonators.

2. The installation method according to claim 1, wherein at the sending step, said data set to store in memory is sent to all the detonators of said set of electronic detonators, said data set being stored in saving means of each detonator of said set of electronic detonators.

3. The installation method according to claim 1, wherein said data set to store in memory further comprises a reference of said mining face.

4. The installation method according to claim 1, wherein said set of values comprises the total number of electronic detonators connected to the movable test device.

5. The installation method according to claim 1, each detonator comprising memory means for storing at least one reference of delay category chosen from among a predefined set of delay categories, wherein said installation method further comprises, for each delay category, a step of issuing a test command by said movable test device to a sub-set of electronic detonators comprising a same reference of delay category stored in memory and wherein, at the determining step, said set of values comprises, for each delay category, the number of electronic detonators comprising said same reference of delay category stored in memory.

6. The installation method according to claim 1, each detonator comprising memory means for storing at least one reference of delay category chosen from among a predefined set of delay categories, wherein at the step of receiving, by said movable test device, a message sent by each detonator of said set of electronic detonators, said message comprises at least the reference of delay category stored in said memory storage means of said detonator, and wherein at the determining step, said set of values comprises, for each delay category, the number of electronic detonators comprising said same reference of delay category stored in memory.

7. The installation method according to claim 5, wherein said data set to store in memory comprises the number of delay categories of said predefined set of delay categories.

8. The installation method according to claim 5, wherein at said memory storage step, the number of electronic detonators comprising said stored reference of delay category is stored respectively in the saving means of at least one electronic detonator comprising said stored reference of delay category.

9. The installation method according to claim 5, further comprising:

selecting, in the movable test device, a template of associations of each delay category with a predefined delay according to a predetermined firing layout; and programming a firing delay in each detonator of said set of electronic detonators based on said template of associations and the reference of delay category stored in the memory storage means of said detonator.

10. The method for firing a set of electronic detonators installed at the mining face according to the installation method in accordance with claim 1, implemented in a firing device, the method comprising:

connecting said set of electronic detonators to the firing device;

receiving a message sent by each detonator of said set of electronic detonators;

receiving said data set stored in said saving means of one or more detonators of said set of electronic detonators;

extracting, from said stored data set, said set of values representing the total number of electronic detonators connected to the movable test device at the time of installing said set of electronic detonators at the mining face;

determining the current number of electronic detonators of said set of electronic detonators connected to the firing device based on the message sent by each detonator of said set of electronic detonators;

comparing said current number with said set of values representing the total number of electronic detonators connected to the movable test device; and issuing a validation message for a test if said current number is consistent with said set of values representing the total number and a non-validation message if said current number is not consistent with said set of values representing the total number.

11. The method for firing a set of electronic detonators installed at the mining face according to the installation method in accordance with claim 5, implemented in a firing device, the method comprising:

connecting said set of electronic detonators to the firing device;

receiving a message sent by each detonator of said set of electronic detonators, said message comprising at least the reference of delay category stored in said memory storage means of said detonator;

receiving said data set stored in said saving means of one or more detonators of said set of electronic detonators;

extracting, from said stored data set, said set of values comprising, for each delay category, the number of electronic detonators comprising said stored reference of delay category;

determining, for each delay category, the current number of electronic detonators comprising said stored reference of delay category from said message sent by each detonator of said set of electronic detonators;

comparing, for each delay category, said current number with said number of electronic detonators comprising said stored reference of delay category; and issuing a test validation message if said current number is equal to said number of electronic detonators comprising said stored reference of delay category for all the delay categories, and a message of non-validation if said current number is different from said number of electronic detonators comprising said stored reference of delay category for at least one delay category.

12. The method for firing a set of electronic detonators installed at the mining face according to the installation method in accordance with claim 5, implemented in a firing device, the method comprising:

connecting said set of electronic detonators to the firing device;

sending, for each delay category, a test command by said firing device to a sub-set of electronic detonators comprising a same stored reference of delay category;

receiving, for each delay category, a message sent by each detonator of said sub-set of electronic detonators comprising said same stored delay category;

receiving said data set stored in said saving means of one or more detonators of said set of electronic detonators;

extracting, from said stored data set, said set of values comprising, for each delay category, the number of electronic detonators comprising said stored reference of delay category;

determining, for each delay category, the current number of electronic detonators comprising said stored reference of delay category, from said message sent by each detonator of said subset of electronic detonators comprising said same stored delay category;

comparing, for each delay category, said current number with said number of electronic detonators comprising said stored reference of delay category; and issuing a test validation message if said current number is equal to said number of electronic detonators comprising said stored reference of delay category for all the delay categories, and a message of non-validation if said current number is different from said number of electronic detonators comprising said stored reference of delay category for at least one delay category.

13. Firing method according to claim 11, wherein at the step of issuing a non-validation message, the delay category or categories of which the current number is different from said number of electronic detonators comprising said stored reference of delay category is or are identified.

14. The firing method according to claim 11, further comprising:

selecting a template of associations of each delay category with a predefined delay according to a predetermined firing layout; and programming a firing delay in each detonator of said set of electronic detonators based on said template of associations and the reference of delay category stored in the memory storage means of said detonator.

15. A movable test device for implementing the installation method according to claim 1, comprising:

receiving means for receiving a message sent by each detonator of said set of electronic detonators charged in blast holes;

determining means for determining, from said message sent by each detonator, a set of values representing the total number of electronic detonators connected to said movable test device; and sending means for sending, to one or more detonators of said set of electronic detonators, a data set to store comprising said set of values representing the total number of electronic detonators connected to said movable test device.

16. A firing system for firing a set of electronic detonators installed at the mining face according to the installation method in accordance with claim 1, comprising a movable test device configured to be connected to a bus line, the electronic detonators being connected to said bus line, and a firing device configured to be remotely connected via a firing line to said bus line.

17. The firing system according to claim 16, each detonator of said set of electronic detonators comprising memory means for storing a reference of delay category chosen from among a predefined set of delay categories, wherein each delay category is identified by a predefined combination of a numerical code and of a color code, said numerical code being stored in memory as a reference of delay category in said memory means of each electronic detonator.

18. The firing system in accordance with claim 17, wherein said numerical code and said color code of each predefined combination are visible on at least one location chosen from among a connection cable of said electronic detonator or a connector of said electronic detonator to the bus line.

19. The installation method according to claim 2, wherein said data set to store in memory further comprises a reference of said mining face.

20. The installation method according to claim 2, wherein said set of values comprises the total number of electronic detonators connected to the movable test device.

* * * * *